United States Patent [19]

Zumsteg

[11] Patent Number: 4,915,254

[45] Date of Patent: Apr. 10, 1990

[54] CLOSURE UNIT MADE OF SHEET METAL OR PLATING, METHOD OF MANUFACTURING SUCH A CLOSURE UNIT AND CONTAINER HAVING A CLOSURE UNIT OBTAINED THEREBY

[75] Inventor: Horst Zumsteg, Rorschach, Switzerland

[73] Assignee: Alcan Rorschach AG, Rorschach, Switzerland

[21] Appl. No.: 280,304

[22] Filed: Dec. 5, 1988

[30] Foreign Application Priority Data

Dec. 14, 1987 [CH] Switzerland ..... 48678/76

[51] Int. Cl.[4] ..... B65D 41/00

[52] U.S. Cl. ..... 220/359; 220/265; 229/123.1

[58] Field of Search ..... 220/66, 67, 265, 270, 220/359; 229/5.5, 5.6, 123.1, 125.13

[56] References Cited

U.S. PATENT DOCUMENTS

| | | | |
|---|---|---|---|
| 2,063,550 | 12/1936 | Hodgson | 220/258 |
| 3,547,305 | 12/1970 | Khoury | 220/359 |
| 4,253,584 | 3/1981 | Bloeck et al. | 220/359 |
| 4,328,905 | 5/1982 | Hardt | 220/359 X |
| 4,540,105 | 9/1985 | Wright | 220/359 |
| 4,544,080 | 10/1985 | Wright et al. | 220/359 |
| 4,557,398 | 12/1985 | Hambleton et al. | 220/270 |
| 4,637,543 | 1/1987 | Kucherer | 229/5.6 |

FOREIGN PATENT DOCUMENTS

| | | |
|---|---|---|
| 0090957 | 10/1983 | European Pat. Off. . |
| 0563284 | 5/1975 | Switzerland . |
| 2166409 | 5/1986 | United Kingdom . |

*Primary Examiner*—Stephen Marcus
*Assistant Examiner*—Nova Stucker
*Attorney, Agent, or Firm*—Werner W. Kleeman

[57] ABSTRACT

The closure unit can be manufactured in a single deep-drawing operation. During the course of a predetermined stroke of the single deep-drawing operation, such as the downward stroke up to a lower dead-center position, a blank is punched out, a ring or marginal rim and a collar are formed, a central opening is punched out and a section extending peripherally to the cut edge is downwardly extended. During the upward stroke predetermined sections of the extended collar are rolled and subsequently squeezed together.

10 Claims, 1 Drawing Sheet

CLOSURE UNIT MADE OF SHEET METAL OR PLATING, METHOD OF MANUFACTURING SUCH A CLOSURE UNIT AND CONTAINER HAVING A CLOSURE UNIT OBTAINED THEREBY

BACKGROUND OF THE INVENTION

The present invention relates to a new and improved closure unit made of sheet metal or plating for sterilizable containers, to a new and improved method of manufacturing such a closure unit, and also relates to a container having a closure unit made of sheet metal or plating and obtained thereby.

Generally speaking, the closure unit of the present development is of the type comprising a holding or fastening ring which can be beaded or flanged over the associated container. The closure unit also comprises a ring area or region having a sealing surface for sealing thereto a membrane which has a tear-back tab and which covers a closure opening. The cut edge of the closure opening is folded or bent over into the sealing surface.

Closure units of the aforementioned type equipped with a membrane closure member which covers a container or closure opening and which can be peeled off or torn away from the holding or fastening ring of the closure unit, are used for containers, cans and the like for packing foodstuffs and industrial products.

Such type of closure unit is known, for example, from U.S. Pat. No. 4,253,584, granted Mar. 3, 1981, entitled "Ring and Closure for Cans". There is disclosed a cover ring suitable as a food can closure. The can for foodstuffs is made of lacquered aluminum or tin-plate. To protect the exposed cut edge laid bare by punching out the discharge or pour opening, the cut edge is bent over upwards and outwards into the sealing plane for the tear-back membrane. The unprotected cut edge is thus located beyond the filled material and cannot contaminate such filled material. Protection from corrosion by environmental factors, for instance during the filling of the container or by atmospheric moisture, is not in any way ensured.

To increase the resistance or strength of the sealing rim formed along the discharge or pour opening, a hollow curved portion is formed by the bent-over or turned-over cut edge. When the tear-back membrane is sealed onto the bent-over sealing surface, because of this hollow curved portion a sealing action with the required high sealing pressure only can be realized at the narrow ring area or region located beyond the hollow curved portion. The sealing surface and the membrane to be sealed thereto cannot be adequately and sufficiently pressed against each other in the region of the hollow curved portion in order to achieve a positive closure suitable for sterilization. This known ring and closure for cans have a further disadvantage in that when the ring is beaded or flanged over the can edge or rim, the membrane which in most cases is only a few hundredths of a millimeter thick and particularly the tear-back or pull-off tab folded back toward the center and onto the surface of the membrane can be damaged by the relative movement of the pressure plate of the beading or flanging machine at the beginning of the beading or flanging operation, such that the tearing back of the membrane is no longer thereafter ensured.

A further prior art construction of closure unit for a container is known from the published United Kingdom Patent Application No. 2,166,409 A, published May 8, 1986, entitled "Closures with Pull Tabs". Similar to the ring and closure disclosed in the aforementioned and discussed U.S. Pat. No. 4,253,584, this known closure comprises a hollow annular bead adjacent the container opening. When the composite membrane is bonded to the outer surface of the metallic closure, the hollow annular bead prevents the membrane from being sterilizingly sealed to the closure across the entire sealing surface thereof. To prevent damage to the pull tab by the pressure pad of the beading or flanging machine, the pull tab is double folded, thereby forming a double layer tab, such that at the most only one layer can be damaged by the beading or flanging machine while the layer lying therebelow can withstand the beading or flanging operation without damage.

Another construction of container cover of this type is known from Swiss Patent No. 563,284, granted May 15, 1975. There is described a metal foil membrane sealed onto the cut edge of the container opening. This cut edge is bent over upwards and outwards. Since the container opening is arranged in the central part of the closure cover and in spaced relationship to the flange or rim portion thereof which is to be bonded to the container, the tear-back tab is prevented from being damaged when the membrane or lid is sealed to the bent-over cut-edge portion of the metal foil membrane. However, the cut edge is not protected against corrosion.

Containers with a pour or discharge opening which does not span or extend across the entire cross-section of the container are not suitable for packing foodstuffs. In particular they are unsuitable for packing solid foodstuffs which cannot be poured out.

Still a further construction of closure cover is known from European Published Patent Application No. 0,090,957, published Oct. 12, 1983. There is described a closure cover for sterilizable containers, in which closure cover the cut edge of the pour opening is also bent over upwards and outwards into the plane of a hot sealing surface. This hot sealing surface is thus not only formed by the bent-over section, but moreover the peripheral region of the end surface located beyond the cut edge is shaped by deep drawing in that the surface of such peripheral region comes to lie in the plane of the bent-over cut edge. In this manner, there is achieved an enlargement of the hot sealing surface. This closure cover also has the disadvantage that the pull-off tab may be damaged by the pressure pad of the beading or flanging machine. Furthermore, the provision of the two-part hot sealing surface requires that both sides of the container cover ring must be provided with a sealing lacquer coating.

SUMMARY OF THE INVENTION

Therefore, with the foregoing in mind it is a primary object of the present invention to provide a new and improved closure unit made of sheet metal or plating for sterilizable containers in which the unprotected cut edge of the pour or discharge opening can neither corrode by contact with the filled material or contents nor because of environmental influences and wherein the cross-section of the utilizable pour or discharge opening is essentially only diminished in size by the magnitude of the sealing surface.

A further significant object of the present invention aims at providing a new and improved construction of closure unit comprising a tear-back tab at the membrane or lid which cannot be damaged by the rotating pressure pad of the beading or flanging machine or the like and improved container provided with such closure unit.

Still another important object of the present invention is to provide an improved construction of closure unit with protected cut edge and method of fabricating such closure unit which are not afflicted with the shortcomings and drawbacks of the prior art.

Now in order to implement these and still further objects of the invention, which will become more readily apparent as the description proceeds, the closure unit of the present development, among other things, is manifested by the features that the ring area or region comprises three substantially parallel, superjacent or superimposed and folded material sections which constitute a top material section forming the sealing surface of the ring area or region, an intermediate material section and a bottom material section. The cut edge is located at the intermediate material section disposed between the top material section and the bottom material section.

The three substantially parallel, superjacent or superimposed and folded material sections lie substantially flat and snugly against one another in the region underlying or situated adjacent the membrane.

The top material section and the bottom material section form a fold and the cut edge at the intermediate material section terminates or ends at the inner surface of the base or bottom of such fold.

A peripherally located fold formed by the top material section and the intermediate material section is upwardly bent over or upwardly flexed and the apex of this bent-over peripherally located fold advantageously lies at a distance above the surface of the top material section, and which distance is greater than twice the thickness of the membrane.

As alluded to above, the invention is not only concerned with the aforementioned closure unit, but also deals with a new and improved method of manufacturing such closure unit formed of sheet metal or plating and having a holding or fastening ring and a ring area or region enclosing the central opening defining a pour or discharge opening. This ring area comprises three parallel, superjacent or superimposed and folded material sections for sealing on or sealingly attaching a membrane thereto. The method of this development importantly contemplates effecting in a single deep-drawing operation all shaping and punching operations performed upon a blank from which there is formed the closure unit.

This single deep-drawing operation comprises the steps of punching out a blank for the closure unit, peripherally shaping a holding or fastening ring and cupping the central portion of the blank to form a substantially cup-shaped part. The bottom of this cup-shaped part is then punched out, thus providing the central opening. As a next step, the sections adjacent the central opening are rolled back into the cup-shaped part, whereby these rolled-in sections are then flattened.

Alternatively the single deep-drawing operation can comprise the steps of punching out a blank for the closure unit, peripherally shaping a holding or fastening ring and cupping the central portion of the blank to form a substantially cup-shaped part. Thereafter a portion of the bottom or base of this cup-shaped part is punched out, thus forming the central opening which has a diameter smaller than the cup-shaped part. As a further step, the section adjacent the central opening is drawn out straight or extended to define a cylinder or tube-shaped portion or section. Finally, the straightened sections adjacent to the central opening are rolled back into the cup-shaped part and are then flattened.

The closure unit constructed according to the invention surprisingly renders possible a trouble-proof and faultless protection of the cut edge against influences from the inside as well as from the outside, without having to apply an additional corrosion-resisting coating. At the same time, it is possible with the closure unit constructed according to the invention to render essentially the entire ring area or region utilizable as the sealing surface, since there is no rolled bead or bulge preventing the formation of a perfect or faultless seal. The three snugly folded material sections lying superjacently against one another, and which material sections may be bonded together depending on the type of coating used, form an inherently stable and substantially a totally utilizable sealing surface for the attachment of the membrane of the closure unit.

The raised peripheral apex of the fold region of the two upper material sections prevents that the tear-back tab lying on the membrane is damaged, without hindering the beading or flanging operation performed on conventional machines. This raised fold region additionally renders possible a simple and exact centering of the membrane before sealing and prevents the unintentional sealing-on or attachment of the membrane at the border or marginal portion of the closure unit. There is thus provided a perfect prerequisite for the positive peeling-off or removal of the membrane.

The inventive method of manufacturing the closure unit of the present development renders possible the manufacture of such closure unit in one single deep-drawing stroke or operation containing all shaping, cutting or punching operations.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the structure of the closure unit has been illustrated therein as is needed to enable one skilled in the art to readily understand the underlying principles and concepts of this invention.

Figure 1:
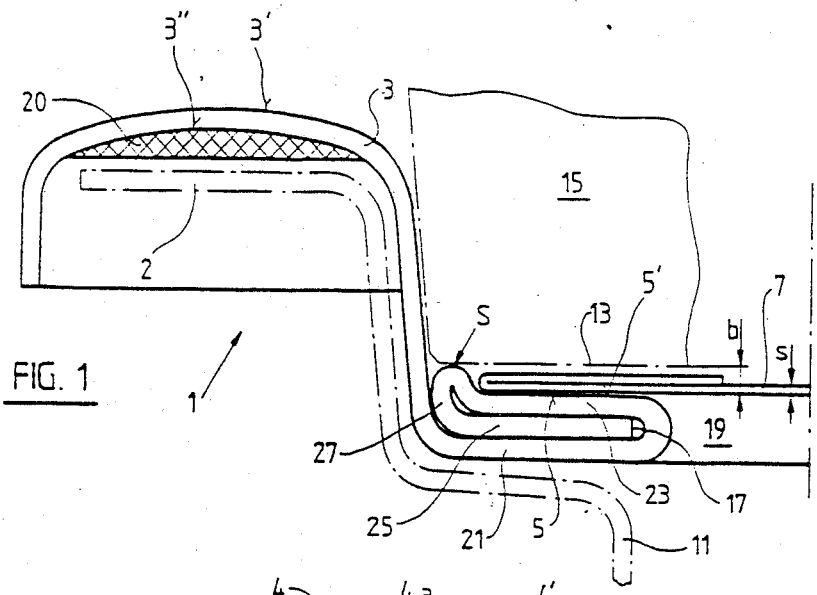
FIG. 1 is a cross-sectional view through the flanged or beaded rim and the sealing surface of a closure unit constructed according to the invention.

Turning attention now specifically to the exemplary embodiment of closure unit for a container or the like as schematically depicted in FIG. 1 of the drawings, and suitable for the performance of the inventive method, the structure specifically illustrated therein by way of example and not limitation, will be seen to comprise a closure unit 1 having a holding or fastening ring or ring member 3, which can be flanged or beaded over a container rim or edge 2, and a ring area or region 5 for sealing on or attachment of a closure membrane 7 or the like. As shown in FIG. 1 depicting in section the one-half or left-hand portion of the closure unit 1, the holding or fastening ring 3 is configured or structured to possess a shape for establishing a proper flanged or beaded connection with the rim or edge 2 of a container 11 formed of, for instance, tin plate and illustrated in phantom or dash-dot lines. In the case of containers formed of aluminum, plastic materials, paper or a composite of different materials, the rim or edge of the holding or fastening ring 3 may have a form or shape which differs from that shown by way of example in FIG. 1 of the drawing. A tear-back or pull-off tab 13 is provided at the closure membrane 7. This tear-back tab 13 is bent over upwardly and back onto the surface of the closure membrane 7.

Above the ring area or region 5 there is representatively shown in phantom or dash-dot lines a rotating pressure or contact plate or disc 15 of a beading or flanging machine for sealing on or attaching the closure membrane 7.

A cut edge 17 resulting from punching out the central part or portion of the closure unit 1 to form a discharge or pour opening 19 lies protectedly between material sections 21 and 23 of the closure unit 1. These material sections 21 and 23 as well as a material section 25 adjacent to the cut edge 17 are formed, as will be hereinafter described in greater detail, by rolling or upcoiling a radially external zone or sector 10 adjacent to the cut edge 17 and by subsequently pressing or squeezing together the thus formed material sections 21, 23 and 25. After this pressing operation, these three material sections or sections 21, 23 and 25 lie substantially parallel to one another and in mutual contact with each other. This is particularly depicted in FIG. 1.

A peripheral bending crease or fold sector or fold 27 of the material sections 23 and 25 is bent over upwardly or raised such that an apex S comes to lie higher by a distance b than the surface of the material section 23 which forms the sealing surface 5' of the ring area or region 5. This distance b is thus greater than twice the thickness s of the closure membrane 7.

A possible manufacturing procedure for the closure unit 1 is described hereinafter in conjunction with FIGS. 2 through 7 of the drawings.

The blanks **4*a* for the closure unit 1 are stamped out of a strip or plate 4 of sheet metal or plating. By performing deep-drawing operations on such blanks 4*a* the latter are then each provided with a flangeable holding or fastening ring or ring member 3 which can be structured according to the shape or form of the rim or edge 2 of the associated container 11**.

Figure 6:
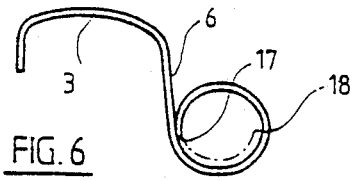
Figure 7:
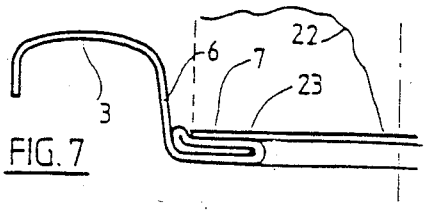

In a second step a circular disc or blank 9 is punched out in order to provide a central discharge or pour opening 19 (FIG. 4) and the peripheral zone or sector 10 is cylindrically turned or folded down. This cylindrical zone or sector 10 is then rolled or upcoiled until the cut edge 17 comes to rest at a collar or collar section 6 which is located below the flangeable holding or fastening ring 3. The zone or sector 10 with the cut edge 17 is then spirally passed on or further curled along a now totally closed bulge or curved section 18 until this bulge or curved section 18 comprises about half an overlapping as shown in phantom or dash-dot lines in FIG. 6. The bulge or curved section 18 is now pressed or squeezed together until the three material sections 21, 25 and 23 which are thus formed lie flat and snug upon one another. The shaping or forming steps according to FIGS. 2 through 5 are performed during the travel path of the tool up to the lower dead-center position while the shaping or forming steps according to FIGS. 6 and 7 are effected during the upward stroke of the tool.

A shaping or squashing tool 22 (FIG. 7) preferably does not quite extend to the collar or collar section 6 at the holding or fastening ring 3, so that the peripheral bending crease or fold sector or fold 27 between the material sections 23 and 25 is bent over or folded upwardly and the apex S thereof comes to lie at the distance b above the surface of the material section 23 which forms the bonding or sealing surface 5' of the ring area or region 5.

The holding or fastening ring 3 can be formed of aluminum, tin plate or tin-free steel, also known as TFS. The outer side 3' of this holding or fastening ring 3, which outer side 3' is the upper side 4' in the showing of FIG. 2, can comprise, if necessary, a protective coating against corrosion by environmental conditions. Such a protective coating can be a film of polypropylene or another suitable protective lacquer. It is not necessary to strive for or examine the compatibility of such a coating or film with the container contents or filled material, because the outer coating can never come into contact with the container contents or filled material.

Figure 2:
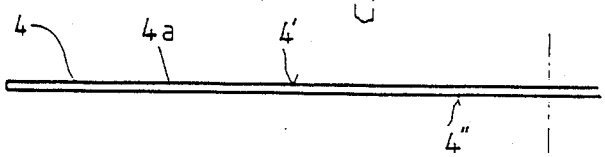
FIGS. 2 through 7 illustrate by way of example the shaping or forming stages involved in the process of manufacturing the closure unit in accordance with the inventive method.
Figure 3:
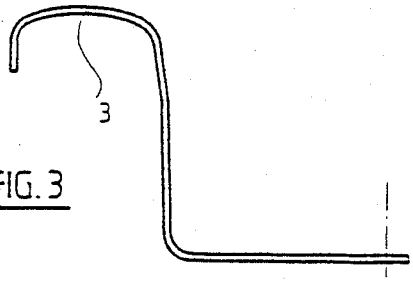
Figure 4:
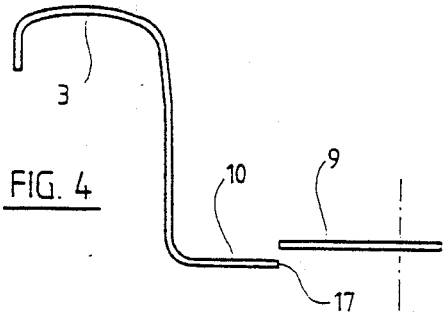
Figure 5:
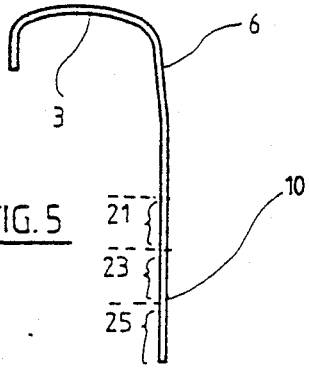

The inner side 3'' of the holding or fastening ring 3, and which is the lower side 4'' in the showing of FIG. 2, preferably comprises a sealable coating, because this inner side 3'' has to form the adhesive bonding or sealing surface 5' for the closure membrane 7 and, if need be, should this closure membrane be formed of plastic material, also assumes a sealing function in place of a separately injected compound 20 when the closure unit is beaded or flanged over.

As coatings there can be utilized, for example, polypropylene, a plastic material film or another sealable lacquer.

While there are shown and described present preferred embodiments of the invention, it is to be distinctly understood that the invention is not limited thereto, but may be otherwise variously embodied and practiced within the scope of the following claims. Accordingly,

WHAT I CLAIM IS:

1. A closure unit formed of sheet metal for sterilizable containers, comprising:

a holding ring having a ring area;

said ring area having a sealing surface;

said holding ring being flangeable to an associated sterilizable container;

said ring area defining a closure opening having a cut edge;

said cut edge of said closure opening being bent over into said ring area;

a membrane having a tear-back tab;

said membrane covering said closure opening and being sealed onto said sealing surface of said ring area;

said ring area comprising three substantially parallel, superjacent and folded material sections;

said three substantially parallel, superjacent and folded material sections defining a top material section forming said sealing surface of said ring area, an intermediate material section and a bottom material section; and said cut edge being located at said intermediate material section between said top material section and said bottom material section.

2. The closure unit as defined in claim 1, wherein:

said three substantially parallel, superjacent and folded material sections lie substantially flat and snugly against one another in a region situated adjacent said membrane.

3. The closure unit as defined in claim 2, wherein:

said top material section and said bottom material section form a fold having a base; and said cut edge located at said intermediate material section terminating at the base of said fold.

4. The closure unit as defined in claim 3, wherein:

said top material section and said intermediate material section form a peripherally located fold; and said peripherally located fold defining a raised 5. The closure unit as defined in claim 4, wherein:

said membrane has a predetermined thickness;

said raised fold comprises an apex;

said apex of said raided fold being disposed at a distance above said top material section forming said sealing surface of said ring area; and said distance being greater than twice said predetermined thickness of said membrane.

6. The combination of a container and a closure unit formed of sheet metal, wherein:

said closure unit comprises:

a holding ring having a ring area;

said ring area having a sealing surface;

said holding ring being flangeable to said said ring defining a closure opening having a cut edge;

said cut edge of said closure opening being bent over into said ring area;

a membrane having a tear-back tab;

said membrane covering said closure opening and being sealed onto said sealing surface of said ring area;

said ring surface comprising three substantially parallel, superjacent and folded material sections;

said three substantially parallel, superjacent and folded material sections defining a top material section forming said sealing surface of said ring area, an intermediate material section and a bottom material section; and said cut edge being located at said intermediate material section between said top material section and said bottom material section.

7. The combination as defined in claim 6, wherein:

said three substantially parallel, superjacent and folded material sections lie substantially flat and snugly against one another in a region situated adjacent said membrane.

8. The combination as defined in claim 7, wherein:

said top material section and said bottom material section form a fold having a base; and said cut edge located at said intermediate material section terminating at the base of said fold.

9. The combination as defined in claim 8, wherein:

said top material section and said intermediate material section form a peripherally located fold; and said peripherally located fold defining a raised fold.

10. The combination as defined in claim 9, wherein:

said membrane has a predetermined thickness;

said raised fold comprises an apex;

said apex of said raised fold being disposed at a distance above said top material section forming said sealing surface of said ring area; and said distance being greater than twice the said predetermined thickness of said membrane.

* * * * *

UNITED STATES PATENT AND TRADEMARK OFFICE

CERTIFICATE OF CORRECTION

PATENT NO. : 4,915,254

DATED : April 10, 1990

INVENTOR(S) : HORST ZUMSTEG

It is certified that error appears in the above-identified patent and that said Letters Patent is hereby corrected as shown below:

Column 7, line 19, after "raised" please insert --fold--

Column 7, line 34, after "said" (second occurrence) please insert --container;--

Signed and Sealed this

Ninth Day of July, 1991

*Attest:*

*Attesting Officer*

HARRY F. MANBECK, JR.

*Commissioner of Patents and Trademarks*